US008563487B1

(12) United States Patent
Schramm et al.

(10) Patent No.: US 8,563,487 B1
(45) **Date of Patent: *Oct. 22, 2013**

(54) FRICTION MODIFIER USING ADHERENT METALLIC MULTILAYERED OR MIXED ELEMENT LAYER CONVERSION COATINGS

(75) Inventors: Harry F. Schramm, Winchester, TN (US); Francis G. Defalco, Houston, TX (US); Lloyd L. Starks, Sr., Spring City, TN (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/525,623

(22) Filed: Jun. 18, 2012

Related U.S. Application Data

(63) Continuation-in-part of application No. 12/634,502, filed on Dec. 9, 2009, now Pat. No. 8,252,734.

(51) Int. Cl.
*C10M 125/24* (2006.01)
*C10M 125/26* (2006.01)

(52) U.S. Cl.
USPC ..... 508/162; 508/136

(58) Field of Classification Search
USPC ..... 508/100, 136, 162
See application file for complete search history.

(56) References Cited

U.S. PATENT DOCUMENTS

| | | | | |
|---|---|---|---|---|
| 5,540,788 | A | 7/1996 | Defalco et al. | |
| 6,340,659 | B1 | 1/2002 | Kocsis et al. | |
| 6,642,186 | B2 | 11/2003 | Beatty et al. | |
| 7,124,729 | B2 | 10/2006 | Caracciolo | |
| 7,358,216 | B2 | 4/2008 | Levy | |
| 8,252,734 | B1 * | 8/2012 | Schramm et al. | 508/162 |
| 2008/0268247 | A1 | 10/2008 | Kurihara et al. | |
| 2008/0287326 | A1 | 11/2008 | Zhang et al. | |
| 2008/0302267 | A1 | 12/2008 | Defalco | |
| 2009/0069204 | A1 | 3/2009 | Kamimura et al. | |

* cited by examiner

*Primary Examiner* — Jim Goloboy
(74) *Attorney, Agent, or Firm* — Gerald M. Walsh; James J. McGroary

(57) ABSTRACT

A process for creating conversion coatings and spin, drawing, and extrusion finishes for surfaces, wherein the conversion coatings and spin, drawing, and extrusion finishes contain potassium, phosphorus, nitrogen, and one or more non-alkaline metals and/or one or more metalloids. The process comprises forming an aqueous solution of water, phosphoric acid or sulfuric acid, ammonium hydroxide, an alkali metal hydroxide, and one or more non-alkaline metals and/or one or more metalloids. The aqueous solution forms an anti-friction multilayer conversion and/or mixed element coating or a spin, drawing, and extrusion finish on a surface when applied to the surface, either directly without the use of applied external electromotive force, or as an additive in lubricating fluids.

26 Claims, 6 Drawing Sheets

FRICTION MODIFIER USING ADHERENT METALLIC MULTILAYERED OR MIXED ELEMENT LAYER CONVERSION COATINGS

CROSS REFERENCE TO RELATED APPLICATION

This application is a continuation-in-part of and claims the benefit of U.S. patent application Ser. No. 12/634,502 filed on Dec. 9, 2009 now U.S. Pat. No. 8,252,734.

GOVERNMENT EMPLOYEE INVENTION

The invention described herein was made in part by an employee of the United States Government and may be manufactured and used by or for the Government of the United States of America for governmental purposes without the payment of any royalties thereon or therefor.

BACKGROUND OF THE INVENTION

1. Field of the Invention

The present invention relates to compositions and processes for coating metals and, more particularly, to aqueous compositions of metals for producing conversion surfaces without the use of electromotive force, processes for making these aqueous compositions, and products produced by these processes which provide improved friction-reducing modifiers.

2. Technical Background

It is known that thin mono-molecular oxide films present on stainless steel can provide an excellent passivation surface to metals. It has been theorized that corrosion may one day be conquered by a thin molecular layer on metal surfaces. It has been further theorized that significant reductions in friction could be obtained with thin, tenacious metallic films.

Many methods have been developed to form conversion surfaces on metals, including electroplating, phosphating in chemical vapor deposition, and ion sputtering. Conversion surfaces may be very effective in reducing friction, compared to conventional oil lubricants, but they are expensive to create and require complex methods. Lubricants create a boundary layer between two surfaces which keeps the two surfaces apart. When the lubricant can no longer maintain the boundary the surfaces come into contact and wearing of the surfaces occurs due to friction. Lubricants form only transitory boundary layers and have limited use in reducing friction. Conversion coatings, on the other hand, create relatively long-lasting boundary layers and are more effective in reducing friction. A conversion surface consisting mainly of metal is expected to most likely approach a frictionless surface. Defalco and McCoy (U.S. Pat. No. 5,540,788) demonstrated that molybdenum, zinc, or tungsten can be deposited as a conversion coating on an iron surface when the salts of these metals are first dissolved in an inorganic phosphate polymeric water complex and then delivered in an oil lubricant vehicle to the iron surface. The polymeric water complex by itself forms a phosphate and potassium conversion surface on an iron surface when delivered in the lubricant vehicle. The phosphate/potassium conversion service by itself significantly improved the friction reducing properties of the lubricant vehicle. Adding molybdenum, zinc, or tungsten to the polymeric water complex did not produce an improved anti-friction effect compared to the polymeric water complex alone. In addition the reactions disclosed by Defalco and McCoy require a violent chemical exothermic reaction which makes this process unfeasible commercially. Defalco (US Patent Application No. 2008/0302267) further demonstrated that metal ions and silicate can form conversion coatings on any metal surface if the aqueous delivery media of inorganic phosphate solution was formulated not to form polymeric complexes. His formulation required no violent chemical exothermic reaction. A dry conversion coating of silicon on stainless steel provided the same anti-friction protection by itself as a lubricating oil, using this formulation.

In the October 1996 issue of Scientific American, Jacqueline Krim, PhD, published a paper titled "Friction at the Atomic Scale". Her findings led to the conclusion that "at the atomic level with metal to metal contact there is no friction." This surprising finding called into question many of the beliefs that friction was a condition that could only be alleviated by the use of a lubricant to reduce the heat generated by metals sliding over one another. Another surprising conclusion was that, at the atomic level, "friction arises from atomic lattice vibrations when atoms close to the surface are set into motion by the sliding action of atoms in the opposing surface. These vibrations are really sound waves. In this way, some of the mechanical energy needed to slide one surface over the other, is converted to sound energy, which is eventually transformed into heat." Heat causes friction. To maintain the sliding, more mechanical energy must be added. Krim further posits "Solids vibrate only at certain distinct frequencies, so the amount of mechanical energy depends on the frequencies actually excited. If the atoms in the opposing surface resonates with the frequency of the other surface, then friction arises. But if the opposing surface is not resonant with any of the other surface's own frequencies, then sound waves are not generated. This feature opens the exciting possibility that sufficiently small solids, which have relatively few resonant frequencies, might exhibit nearly frictionless sliding."

Another surprising result of her work was that dry films were slipperier than liquid films. This was counterintuitive to all current thought on friction. Further tests by other scientists validated that metal to metal contact at the atomic level eliminated friction, and that liquid lubricants caused friction with the "stick/slip" action. The liquid would stick in the gaps in the metal and then slip out. This caused vibrations in the lattices and generated sound waves which converted to heat, causing friction.

Although inorganic aqueous solutions containing salts of non-alkaline metals can be formulated to create non-alkaline metal conversion coatings on metals without the use of external electromotive force, they do not appear to offer an advantage over standard liquid or dry organic lubricating agents for reducing friction.

SUMMARY OF THE INVENTION

The present invention provides a process for creating conversion coatings and spin, drawing, and extrusion finishes for surfaces, wherein the conversion coatings and spin, drawing, and extrusion finishes contain potassium, phosphorus, nitrogen, and one or more non-alkaline metals and/or one or more metalloids. The multilayer conversion coating process comprises forming a first aqueous solution of silicate, potassium hydroxide, and ammonium hydroxide; forming a second aqueous solution of water, phosphoric acid or sulfuric acid, ammonium hydroxide, and an alkali metal hydroxide, adjusting the pH to 14 by adding ammonium hydroxide and potassium hydroxide, and adding one or more non-alkaline metals and/or one or more metalloids to this second solution; and then combining the first solution with the second solution in equal volumes to form a final solution. This final solution and the second solution by itself form a multilayer and/or a mixed element conversion coating or spin, drawing, and extrusion finish on a surface when applied to the surface without the use of applied external electromotive force. This final solution and the second solution by itself can also be used as an additive to lubricating oils by adding this solution to oils and fluids such as, for example, motor oils, gear oils, spin, drawing, or extrusion finish oils, or hydraulic fluids. These oils will deliver the elements of the solution to surfaces to form conversion surfaces and increase the friction reducing effects of the oils.

An advantage of the present invention is the formation of an extremely durable conversion coating or spin, drawing, and extrusion finish on a surface which will reduce friction of the surface and increase the friction reducing properties of lubricating oils on the surface.

Another advantage is an aqueous solution for deposition of conversion surfaces and spin, drawing, and extrusion finishes without the use of externally applied electromotive force.

Another advantage is an aqueous solution which can produce multiple layers of friction modifying coatings wherein each layer uses one or more bonding molecules containing different elemental constituents that will produce a different lubricating effect when overlaid on the layer beneath it.

Another advantage is an aqueous solution which can produce a single layer friction modifying coating with a plurality of elemental constituents each producing different lubricating effects in combination.

Another advantage is an additive for spin, drawing, or extrusion finish oils which will improve the manufacture and quality of tufted products, needleloom products, thermobonded products, siliconized fiberfill, spun yarns, concrete reinforcement fibers, and spunlace.

Another advantage is the creation of conversion coatings and spin, drawing, and extrusion finishes that provide long-lasting boundary layers in combination with lubricating oils which are more effective in reducing friction compared to the use of lubricating oils alone.

Another advantage is the creation of a conversion coating further comprising a coating of dry lubricant whereby the conversion coating increases the anti-friction properties of the dry lubricant at both ambient and cryogenic temperatures.

DETAILED DESCRIPTION OF THE INVENTION

Figure 1:
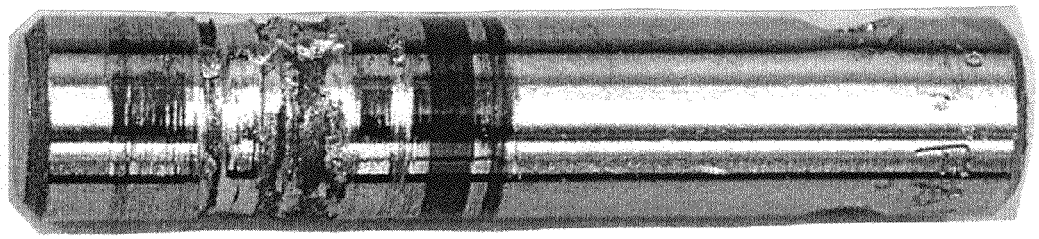
FIG. 1 shows a picture of a pin from a Falex pin and vee-block test on a 15W-40 petroleum motor oil alone.

While the following description details the preferred embodiments of the present invention, it is to be understood that the invention is not limited in its application to the details of formation and arrangement of the components, since the invention is capable of other embodiments and of being practiced in various ways.

Defalco (U.S. Patent Application No. 2008/0302267), incorporated herein by reference, disclosed aqueous compositions and processes for deposition of metal ions onto surfaces. The processes form stable aqueous solutions of metal ions and metalloids (such as boron and silicon) ions that can be adsorbed or absorbed on and/or into surfaces. The aqueous solutions consist of phosphate (or sulfate) ammonium alkali metal salts with a non-alkali metal salt selected from Group I through Group VIII of the periodic table of elements. A single aqueous solution allows for a nano-deposition of the non-alkalai metal ions on and/or into the surfaces. The conversion surfaces created by the deposited non-alkaline metal ions provide substantially reduced friction in metal-to-metal contact without the use of hydrocarbon based lubricants. It is believed that the anti-friction properties of this conversion surface is probably dependent upon the conversion surface being further composed of the nitrogen, potassium, and phosphate ions in the solution.

The present invention combines solutions described by Defalco with a second solution to produce a double or multi-layered conversion surface to increase the anti-friction properties of the conversion surface. When conventional and synthetic lubricants are used in engine and gear applications the lubrication takes place where two surfaces come into contact. The lubricant creates a boundary layer that keeps the two surfaces apart. When the lubricant is unable to organize a boundary layer then the surfaces come into contact and wear (friction) takes place. Conversion coatings create a different type of boundary layer that is more durable than that produced by conventional lubricants. The conversion coatings create a boundary layer that is not worn away over extended use, especially in the presence of conventional lubricants which may serve as a secondary boundary layer or even a co-boundary layer.

The present invention describes an improvement in the creation of friction reducing additives for lubricating fluids. Two or more aqueous fluid solutions are combined in the case of a multilayer conversion coating to create two or more layers of friction modifying conversion coatings. Each layer uses a bonding molecule containing a different elemental constituent that would produce a different lubricating effect when overlaid on the layer beneath it. The first (base) layer conversion coating would be composed of a metallic ion that has a higher affinity for the surface in question and the subsequent layers that would be found on top of the base layer would have somewhat weaker affinities. This configuration would create a multiple boundary layer and a multiple slippage when a sheer force is applied. The multiple slippage would result in a net decrease in friction. A preferred embodiment of the present invention consisting of a First Solution combined with a Second Solution to form Additive A is described below.

First Solution

A first solution comprises a silicate, potassium hydroxide, and ammonium hydroxide in water. This solution consists of 5%-20% by weight of potassium hydroxide, 5%-15% by weight of ammonium hydroxide, and 3% to 15% by weight of a silicate, wherein the silicate can be a sodium silicate, a potassium silicate, ferrosilicon, or combinations thereof.

Example of the First Solution Using Ferrosilicon Rock

Approximately 25 g of ferrosilicon rock (76% Si) is placed in a 500 ml PTFE or PFA 3-neck flask containing a stirring bar, thermometer, and is fitted with a reflux condenser maintained at 15 to 20° C. To this, 100 ml water, 100 ml 28 to 30% aqueous ammonia, and 100 ml 50% aqueous KOH are added, and the mixture is stirred and heated. When the temperature reaches 50 to 60° C. the reaction becomes vigorous and hydrogen gas is liberated as the rock dissolves in the solution. The temperature of the solution is allowed to increase to 90 to 100° C. and the reaction is continued for 12 to 24 hours. After the reaction is complete, the mixture is filtered through coarse filter paper to remove the grayish brown insoluble sludge left behind. The slightly yellow filtrate (about 150 ml) contains potassium ammonium silicate and has a pH of about 14.

Second Solution

A second solution is produced by 1) adding phosphoric acid or sulfuric acid to water, then 2) adding ammonium hydroxide slowly, over a time period of at least 10 minutes, to the solution of phosphoric acid (or sulfuric acid), then 3) adding an alkali metal hydroxide to the solution. An exothermic reaction occurs and the temperature of the aqueous solution is approximately 100 degrees C. The solution will have a pH of about 7; 4) Ammonium Hydroxide is then added to the solution to raise the pH to about 11; 5) Potassium hydroxide is then added to the solution to raise the pH to 14; and 6) a measured amount of a non-alkaline metallic salt can then be introduced into the reaction vessel, stirred and heated until the metallic salt is totally dissolved in the aqueous medium. More specifically, step 1) further comprises forming a solution of 0.5 to 1.5 parts of water with 0.5 to 1.5 parts of phosphoric acid, wherein the phosphoric acid is 75% to 85%; step 2) further comprises adding 0.5 to 1.5 parts of ammonium hydroxide to the solution of step 1), wherein the ammonium hydroxide is 20 to 30%; step 3) further comprises adding 0.5 to 1.5 parts of an alkali metal hydroxide in water to the solution produced by step 2), wherein the alkali metal hydroxide in water is 40% to 60%; and step 6) further comprises adding 0.1 to 10 grams of a non-alkaline metal salt to each 80 to 120 ml of the solution produced by step 5). An alternate step 6) may further comprise adding 0.1 to 10 grams each of one or more non-alkaline metal salts and/or each of one or more metalloids to each 80 to 120 ml of the solution produced by step 5). The solution provided by step 6) forms a conversion coating on a surface when applied to the surface without the use of applied external electromotive force, wherein the conversion coating contains potassium, phosphorus, nitrogen, and one or more non-alkali metals. The solution provided by alternate step 6) forms a conversion coating on a surface when applied to the surface without the use of applied external electromotive force, wherein the conversion coating contains potassium, phosphorus, nitrogen, and one or more non-alkali metals and/or one or more metalloids.

The non-alkaline metal salt may be a salt of copper, silver, gold, beryllium, magnesium, zinc, cadmium, aluminum, gallium, indium, silicon, tin, lead, titanium, zirconium, hafnium, antimony, bismuth, vanadium, niobium, tantalum, selenium, tellurium, chromium, molybdenum, tungsten, manganese, iron, cobalt, nickel, palladium, or rhodium, or a combination thereof. The alkali metal hydroxide may be sodium hydroxide, potassium hydroxide, or lithium hydroxide, or a combination thereof. The metalloids silicon or boric acid (preferably boric acid due to its process compatibility) may be substituted for or combined with a non-alkaline metal salt.

Example of the Second Solution 150 mL water and 150 ml 85% phosphoric acid or sulfuric acid are mixed together in a 1 L three neck flask fitted with a reflux condenser, an addition funnel, a thermometer, and containing a stirring bar. 150 ml 28 to 30% (w/w) aqueous ammonium hydroxide are then added dropwise from the addition funnel to the stirring solution over a period of at least 10 to 20 minutes, during which time the solution becomes hot (80 to 90° C.), and water gently refluxes and condenses back into the flask. After the addition of ammonium hydroxide is complete, 150 ml of 50% KOH are next added drop wise from the addition funnel over another at least 10 to 20 minute period. Once the addition is complete the solution is allowed to cool. The pH of the solution about 7. 50 ml of this solution is placed in another container and 25 ml of 30% aqueous ammonium hydroxide is added to the container to bring the pH of the solution to 10-11. 50 ml of 50% aqueous potassium hydroxide is then added to the container to bring the pH of the solution to 14. Into this solution 2.5 g of ammonium molybdate is added and the mixture is stirred until the molybdate salt dissolves. To form a mixed element conversion coating add 2.5 g of one or more non-alkaline metals and/or one or more metalloids to the mixture and stir until all salts are dissolved.

Aqueous Additive A

The preferred aqueous friction reducing additive of the present invention, which forms a multilayer conversion coating on a surface, is formed by adding an equal volume of the First Solution having potassium silicon to an equal volume of the Second Solution having ammonium molybdate, forming a final solution referred to as Additive A.

Aqueous Additive B

Into a reaction vessel add about 1.0 liter of water and about 1.0 liter of 80% by volume phosphoric or sulfuric acid. Then add about 1.0 liter of 26% by volume ammonium hydroxide slowly over an at least 10 to 20 minute time period. Then add about 1.0 liter of 49% by volume potassium hydroxide slowly over an at least 10 to 20 minute time period. To about 100 ml of this solution add about 1 gram of ammonium molybdate. Stir and heat until the ammonium molybdate is completely dissolved.

Aqueous Additive C

To the 100 ml solution of Additive B containing ammonium molybdate add 1 gram of silver nitrate.

Aqueous Additive D

Aqueous Additive D is the Second Solution with additional non-alkaline metals and/or one or more metalloids that form a mixed element conversion coating.

Aqueous Additives A, B, C and D can be added to lubricating fluids, including, but not limited to, synthetic motor oils, petroleum motor oils, gear oils, spin, drawing, or extrusion finish oils, and hydraulic fluids to improve the anti-friction properties of the lubricating fluids. The additives can be added from 1 part additive to 50 parts lubricating fluid to 1 part additive to 150 parts lubricating fluid, preferably about 1 part additive to 70 parts lubricating fluid. The lubricating fluids can contain any suitable emulsifier with which they are usually formulated, or an emulsifier can be added, preferably AOT (hydrophobic anionic surfactant: sodium bis(2-ethylhexyl)sulphosuccinate).

The Aqueous Additives will form conversion surfaces when applied directly to a surface or when mixed in oils and applied to surfaces. Consequently, these Aqueous Additives can improve the anti-friction properties of all lubricating fluids with regard to metal surfaces coming into contact with each other, or with nonmetal surfaces as in the production of textiles. Using these additives in spin, drawing, or extrusion finish oils will improve the manufacture and quality of tufted products, needleloom products, thermobonded products, siliconized fiberfill, spun yarns, concrete reinforcement fibers, spunlace, and the like. Spin, drawing, or extrusion finishing serves several functions, including (1) reducing the friction developed as the synthetic fibers are passed over metal and ceramic machinery surfaces, (2) imparting fiber-to-fiber lubricity, (3) minimizing electrical static charge buildup, and (4) providing cohesion to the fiber. Typical spin, drawing, or extrusion finish oils include natural hydrophobic oils, such as mineral oil or coconut oil. Formulations of polyethylene glycol are also known. Spin, drawing, and extrusion finishes may need to be removed from the articles woven from the fibers, typically by scouring, to minimize soiling problems. However, an aqueous spin, drawing, and extrusion finish of the present invention is expected to be easily removed with water.

A standard Falex pin and vee-block test was used to test the anti-friction properties of commercially available lubricating oils or dry lubrication with and without Additives A, B, or C. SAE 3135 pins are placed in AISI 1137 blocks and the pins are rotated. The force applied to the pins is increased by 100 pounds every two minutes until the pins fail. Failure occurs when there is a significant increase of torque applied to the pins as a result of the failure of the anti-friction boundary layer of the lubricating oil. The longer the time to failure (TTF, seconds) and/or the greater the force (pounds) applied at the time of failure, the greater the anti-friction properties of the lubrication composition.

Synthetic Motor Oil

A commercially available synthetic motor oil 5W-30 was studied alone in the Falex pin and vee-block test or when formulated with Additives A, B, or C, 1 part additive to 70 parts synthetic motor oil. The results are shown in Table 1. Values are the means±standard errors of 4 experiments. *=significantly different from synthetic oil alone, $p<0.05$.

TABLE 1

Falex Pin and Vee-Block Test - Synthetic Oil Emersion

| | Synthetic Oil Alone | | Plus Additive A | | Plus Additive B | | Plus Additive C | |
|---|---|---|---|---|---|---|---|---|
| | TTF | Force | TTF | Force | TTF | Force | TTF | Force |
| Mean | 386 | 875 | 1170* | 1450* | 951* | 1275* | 990* | 1300* |
| ± SE | 51 | 85 | 113 | 87 | 185 | 155 | 118 | 108 |

These studies showed that Additives A, B, and C all increase wear performance of the synthetic oil. Additive A increased wear performance better, on average, than Additives B and C. Additive D (not shown) also increases wear performance of the synthetic oils similar to Additive C, with the advantage, for example, of being able to form a mixed element solution with zinc and boron (boric acid).

Petroleum Motor Oil

A commercially available petroleum motor oil 15W-40 was studied alone in the Falex pin and vee-block test or when formulated with Additives A or B, 1 part additive to 70 parts petroleum motor oil. The results are shown in Table 2. Values are the means±standard errors of 3 experiments. *=significantly different from synthetic oil alone, $p<0.05$; +=significantly different from Plus Additive B, $p<0.05$.

TABLE 2

Falex Pin and Vee-Block Test - Petroleum Oil Emersion

| | Petroleum Oil Alone | | Plus Additive A | | Plus Additive B | |
|---|---|---|---|---|---|---|
| | TTF | Force | TTF | Force | TTF | Force |
| Mean | 312 | 700 | 1433*, + | 1625*, + | 870* | 1167* |
| ± SE | 17 | 0 | 33 | 25 | 92 | 67 |

These studies showed that Additives A and B increase wear performance of the petroleum oil. Additive A increased wear performance of the petroleum oil significantly more than Additive B.

Dry Lubrication

A commercially available dry lubricant Dow Corning 321 (MoS2 and Graphite) was studied alone in the Falex pin and vee-block test when wiped on the pin and vee-block. For comparison, Additives A or B were wiped on the pin and vee-block, allowed to dry, and then the dry lubricant was wiped on top of the Additive A or Additive B conversion coatings. The results are shown in Table 3. Values are the means±standard errors of 3 experiments. *=significantly different from dry lubricant alone, $p<0.05$.

TABLE 3

Falex Pin and Vee-Block Test - Dry Lubricant Coating

| | Dry Lubrication Alone | | Plus Additive A | | Plus Additive B | |
|---|---|---|---|---|---|---|
| | TTF | Force | TTF | Force | TTF | Force |
| Mean | 705 | 733 | 1067* | 1033* | 1043* | 1000* |
| ± SE | 28 | 33 | 36 | 33 | 58 | 58 |

These studies showed that Additives A and B increased wear performance of the dry lubricant. Additive A increased wear performance better, on average, than Additive B.

Dry Lubrication in the Presence of Liquid Nitrogen

A commercially available dry lubricant Dow Corning 321 (MoS2 and Graphite) was studied alone in the Falex pin and vee-block test when wiped on the pin and vee-block and then immersed in liquid nitrogen. For comparison, Additives A or B were wiped on the pin and vee-block, allowed to dry, and then the dry lubricant was wiped on top of the Additive A or Additive B conversion coatings. The results are shown in Table 3. Values are the means±standard errors of 3 experiments. *=significantly different from dry lubricant alone, $p<0.05$.

TABLE 4

Falex Pin and Vee-Block Test - Dry Lubricant Coating

| | Dry Lubrication Alone | | Plus Additive A | | Plus Additive B | |
|---|---|---|---|---|---|---|
| | TTF | Force | TTF | Force | TTF | Force |
| Mean | 142 | 267 | 310* | 400* | 253* | 333* |
| ± SE | 16 | 33 | 40 | 58 | 23 | 33 |

These studies showed that Additives A and B increased wear performance of the dry lubricant in liquid nitrogen. Additive A increased wear performance better, on average, than Additive B.

All four of the tests combined consistently show that Additive A is better in enhancing the anti-friction properties of lubricants compared to Additive B. These results indicate that the liquid oils act most favorably with Additive A when organizing the boundary layer between the pin and the vee-block.

Figure 2:
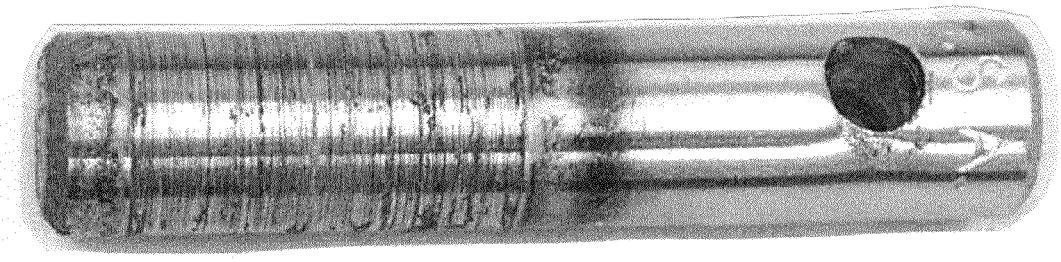
FIG. 2 shows a picture of a pin from a Falex pin and vee-block test on a 15W-40 petroleum motor oil plus the addition of an aqueous solution of the present invention composed of two solutions, with one solution containing a single non-alkaline metal (a molybdenum salt) and the other solution containing a silicate.
Figure 3:
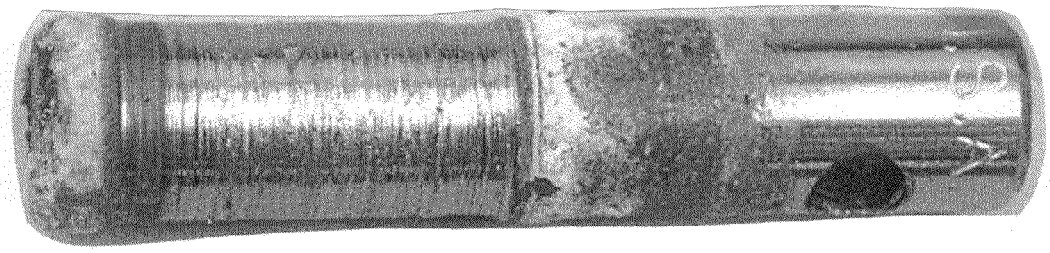
FIG. 3 shows a picture of a pin from a Falex pin and vee-block test on a 15W-40 petroleum motor oil plus the addition of a single aqueous solution containing a single non-alkaline metal (a molybdenum salt).

FIGS. 1, 2, and 3 show pictures of the pins from the tests results described in Table 2. A pin from the test with petroleum motor oil alone is shown in FIG. 1. A pin from the test with petroleum motor oil plus the Additive A is shown in FIG. 2. A pin from the test with petroleum motor oil plus Additive B is shown in FIG. 3. The pin in FIG. 1 shows substantial gouging or galling, characteristic of the other pins in the group treated with the petroleum motor oil alone. The pins in FIGS. 2 and 3 did not show any gouging or galling, characteristic of the pins treated with the petroleum motor oil plus Additive A or Additive B. The solutions of petroleum motor oil alone at the end of the test had detectable particles of metal. The solutions of petroleum motor oil plus Additive A or Additive B at the end of the test had no detectable particles of metal. These results provide qualitative evidence that Additives A and B provide significant improvement in the anti-friction properties of the petroleum motor oil lubricant.

Figure 4:
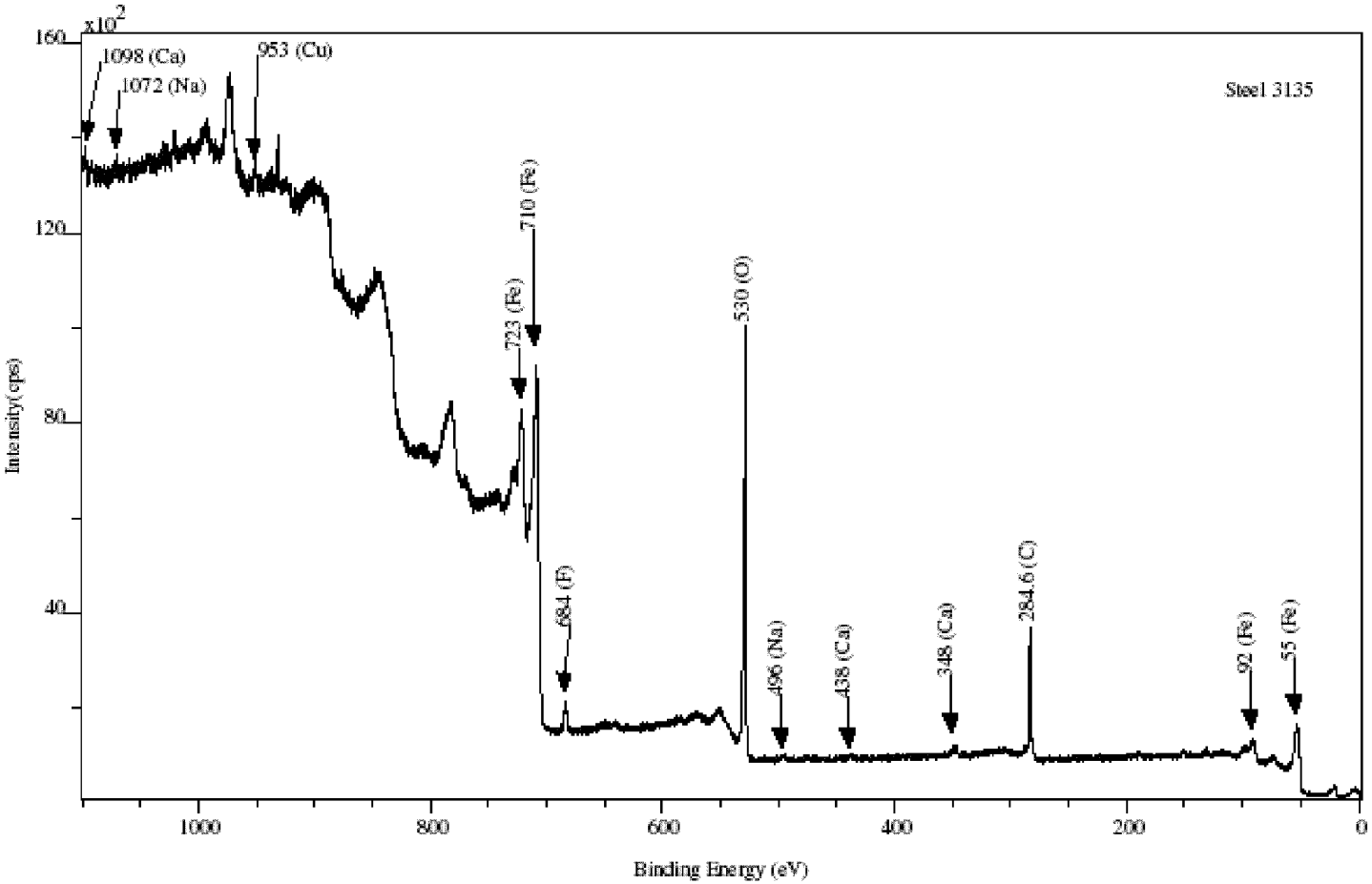
FIG. 4 shows the spectra of an X-ray Photoelectron Spectroscopy (XPS) analysis of the surface of an untreated flat steel panel having no conversion surface.

FIG. 4 shows the spectra of an X-ray Photoelectron Spectroscopy (XPS) analysis of the surface of an untreated flat steel panel having no conversion surface. There is no detectable nitrogen, potassium, phosphorous, molybdenum, or silicon on the surface of the metal.

Figure 5:
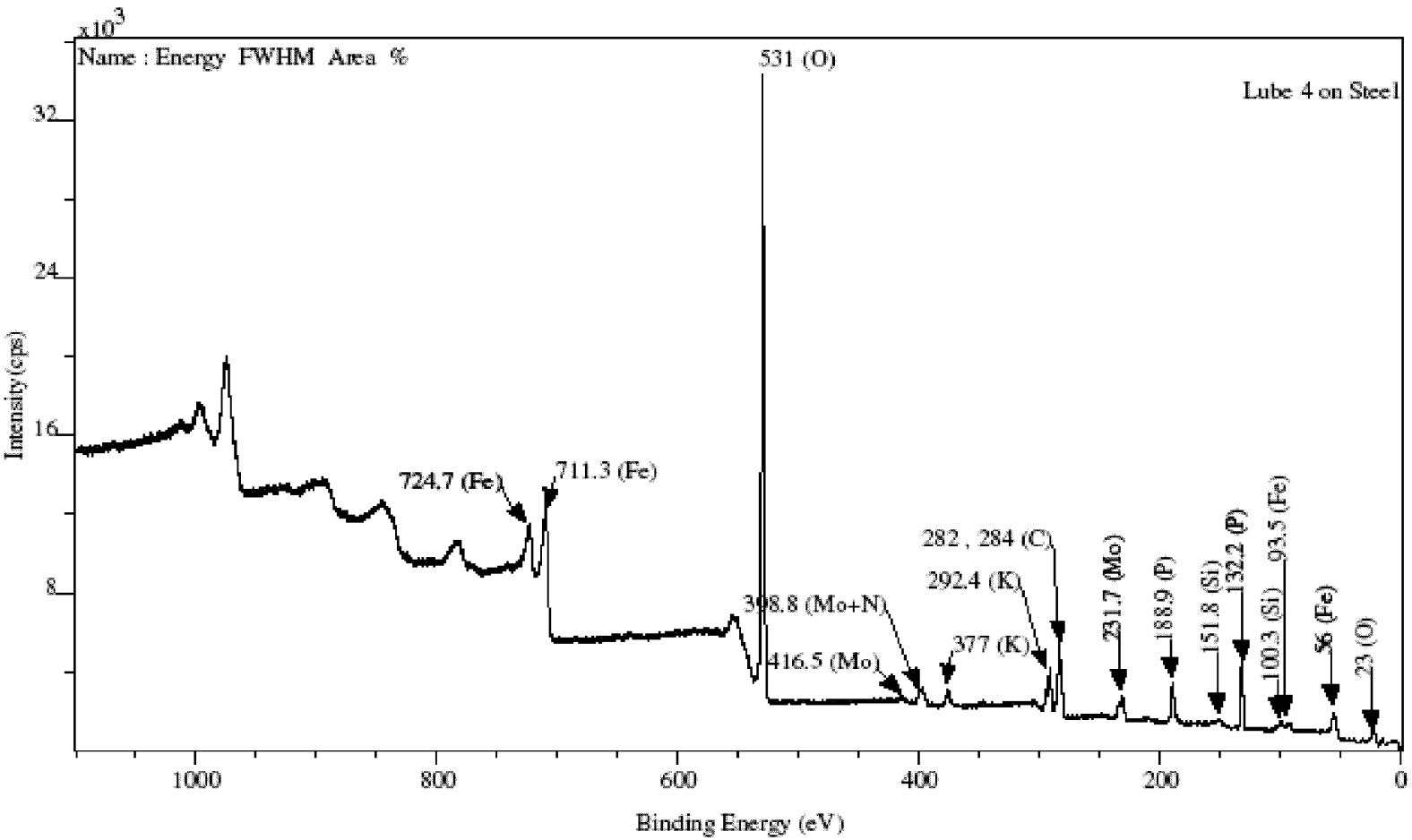
FIG. 5 shows the spectra of an XPS analysis of the surface of a flat steel panel having a conversion surface produced by direct application of an aqueous solution containing a single non-alkaline metal (a molybdenum salt).

FIG. 5 shows the spectra of an XPS analysis of the surface of a flat steel panel having a conversion surface produced by direct manual application of an aqueous solution, Additive B, containing a single non-alkaline metal (a molybdenum salt). The spectra show the presence of nitrogen, potassium, phosphorous, and molybdenum.

Figure 6:
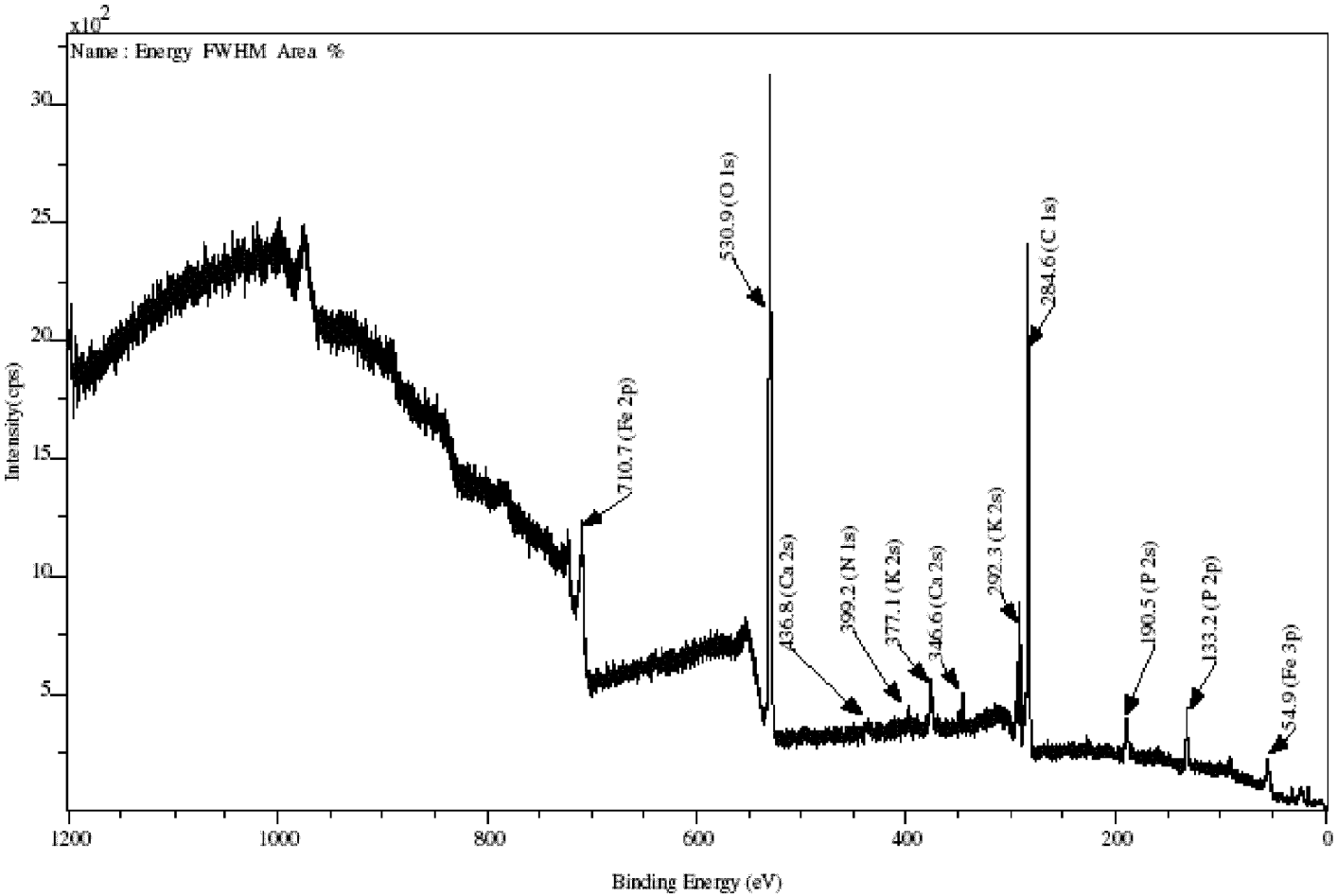
FIG. 6 shows the spectra of an XPS analysis of the surface of pin from a Falex pin and vee-block test on 15W-40 petroleum motor oil having an aqueous additive containing a molybdenum salt.

FIG. 6 shows the spectra of an XPS analysis of the surface of pin from a Falex pin and vee-block test on 15W-40 petroleum motor oil having the aqueous additive, Additive B, containing a molybdenum salt. The spectra show the presence of nitrogen, potassium, phosphorous. The low level of molybdenum was not detectable in this analysis.

Figure 7:
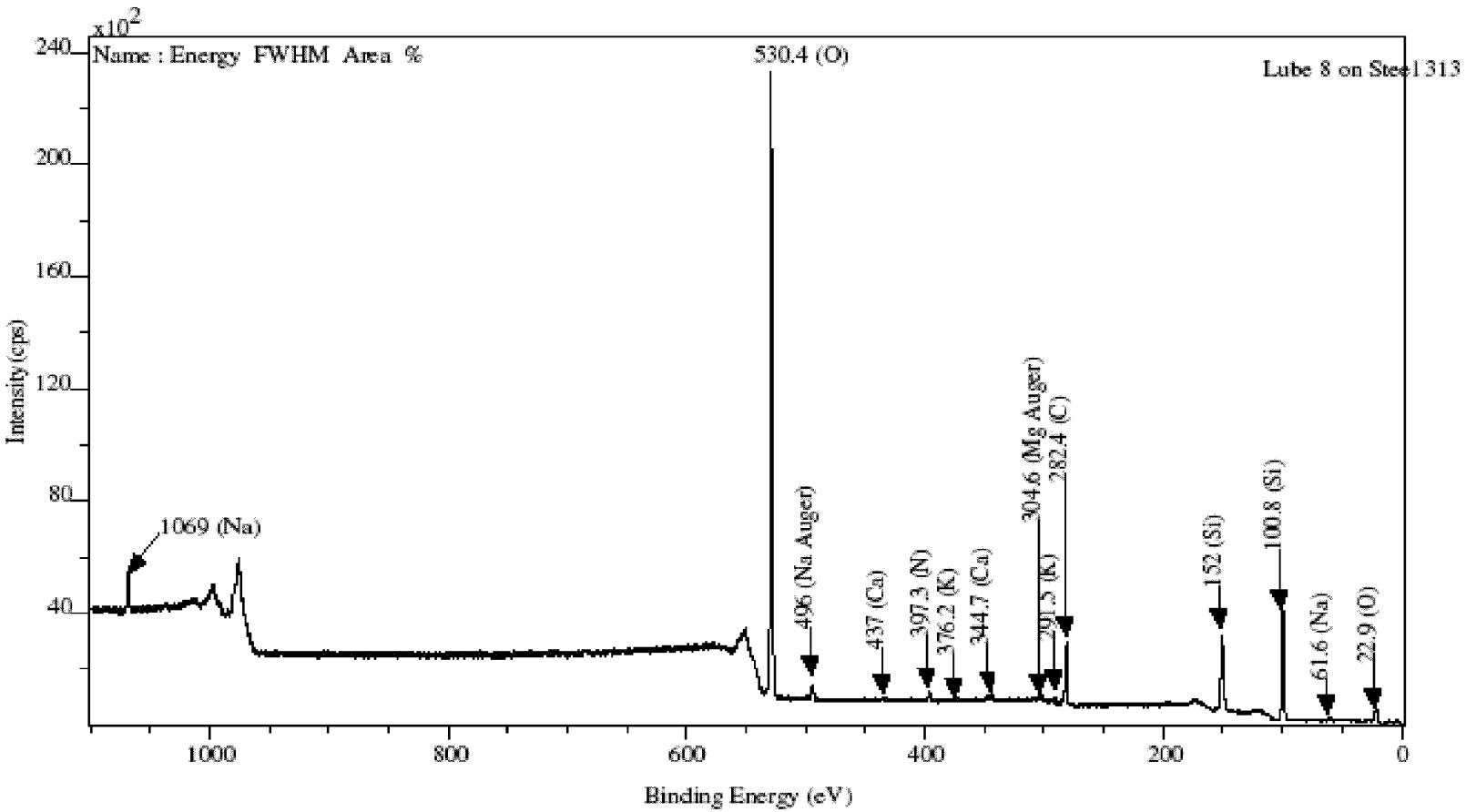
FIG. 7 shows the spectra of an XPS analysis of the surface of a flat steel panel having a conversion surface produced by direct application of an aqueous solution of the present invention, composed of two solutions, with one solution containing a single non-alkaline metal (a molybdenum salt) and the other solution containing a silicate.

FIG. 7 shows the spectra of an XPS analysis of the surface of a flat steel panel having a conversion surface produced by direct application of an aqueous solution of the present invention, Additive A, composed of two solutions, with one solution containing a single non-alkaline metal (a molybdenum salt) and the other solution containing a silicate. The spectra show the presence of nitrogen, potassium, and silicon. The presence of phosphorous and molybdenum are not seen in the spectra, presumably because they are in a layer beneath the layer containing nitrogen, potassium, and silicon.

Figure 8:
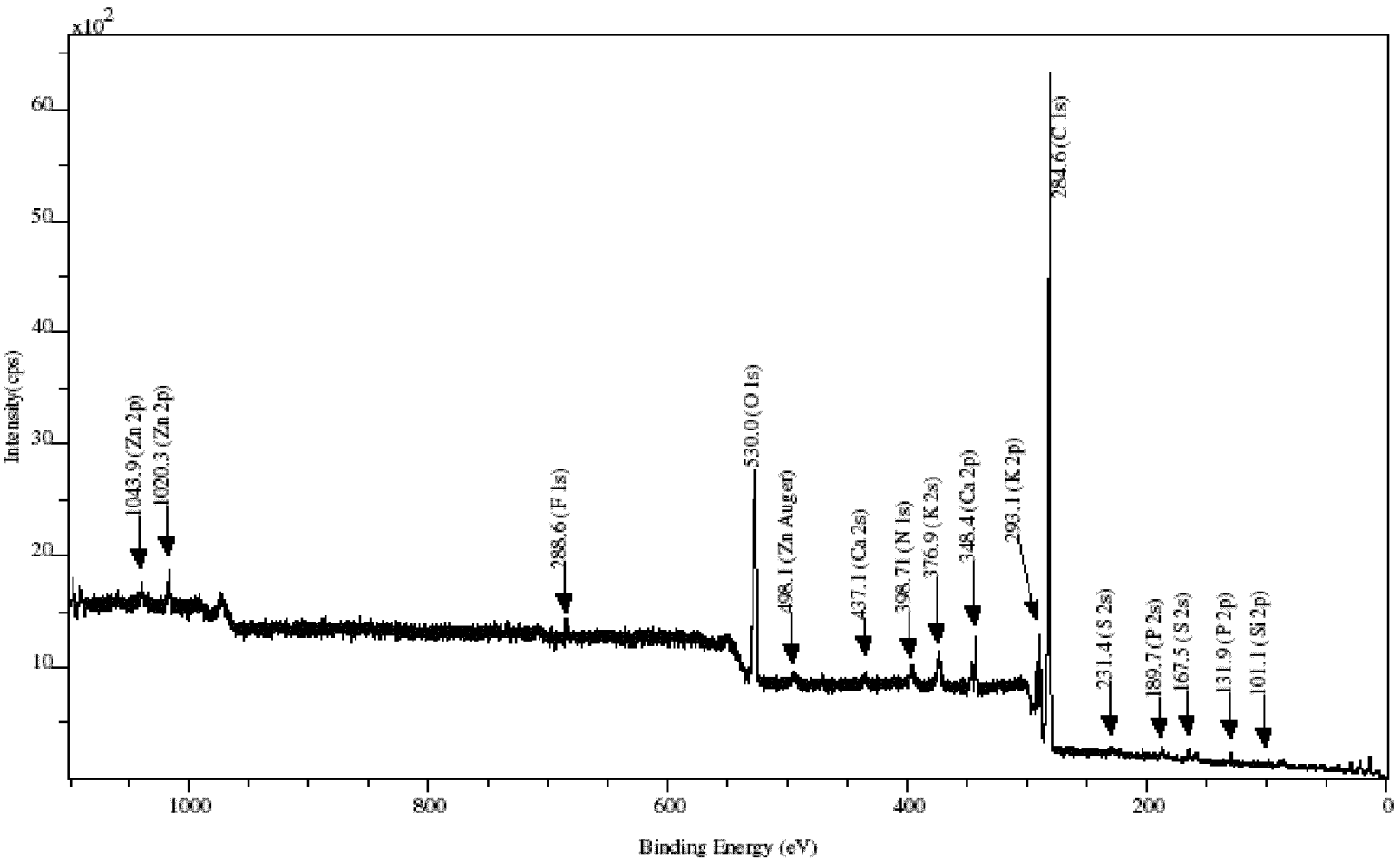
FIG. 8 shows the spectra of an XPS analysis of the surface of a pin from a Falex pin and vee-block test on 15W-40 petroleum motor oil having an aqueous additive of the present invention composed of two solutions, with one solution containing a single non-alkaline metal (a molybdenum salt) and the other solution containing a silicate.

FIG. 8 shows the spectra of an XPS analysis of the surface of pin from a Falex pin and vee-block test on 15W-40 petroleum motor oil having an aqueous additive of the present invention, Additive A, composed of two solutions, with one solution containing a single non-alkaline metal (a molybdenum salt) and the other solution containing a silicate. The spectra show the presence of nitrogen, potassium, phosphorous and silicon. The presence of molybdenum is not seen in the spectra, presumably because it is in a layer beneath the layer containing nitrogen, potassium, and silicon and/or is not detectable because of its low concentration and/or low sensitivity to detection by XPS analysis.

The multi-solution formulations of the present invention can form extremely durable multi-layer anti-friction conversion coatings containing potassium, phosphorus, nitrogen, silicon, and one or more non-alkaline metals. This unique combination of elements in the conversion coatings provide a remarkable improvement in the anti-friction properties of lubricating fluids when added to the lubricating fluids. Thus, these aqueous, inorganic, multi-solution formulations can be applied directly to surfaces or delivered to a surface by an organic lubricant, or both, to produce extremely durable conversion layers which produce substantial improvement in friction reduction compared to known anti-friction methods and formulations.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, variations of Additive A can be made by substituting one or more other non-alkaline metals for ammonium molybdate. If the non-alkaline metal to be added is in cationic form, the phosphate salt is used. If the non-alkaline metal is in anionic form, either the ammonium or potassium salt is used. Thus, if zinc is desired, zinc phosphate is used. If manganese is desired, either manganese phosphate (if a low oxidation state of manganese is desired) or potassium manganate (if a high oxidation state of manganese is desired) is used. A plurality of non-alkaline metals can also be used in combination.

It will be understood that various changes in the details, materials, and arrangements of the parts which have been described and illustrated above in order to explain the nature of this invention may be made by those skilled in the art without departing from the principle and scope of the invention as recited in the following claims.

We claim:

1. A conversion coating comprising potassium, phosphorus, nitrogen, and one or more non-alkaline metals, wherein said conversion coating is produced by a process comprising the steps of:

1) forming a solution of water with phosphoric acid or sulfuric acid;
2) thereafter adding ammonium hydroxide slowly to the solution of step 1) over a period of at least 10 minutes;

3) thereafter adding an alkali metal hydroxide in water to the solution produced by step 2);
4) thereafter adding ammonium hydroxide to the solution produced by step 3) to bring the pH to 10-11;
5) thereafter adding potassium hydroxide to the solution produced by step 4) to bring the pH to 14; and
6) adding one or more non-alkaline metal salts to the solution produced by step 5),
wherein the solution provided by step 6) forms a conversion coating on a surface when applied to the surface without the use of applied external electromotive force, and wherein said conversion coating contains potassium, phosphorus, nitrogen, and one or more non-alkali metals.

2. The conversion coating of claim 1, further comprising a coating of dry lubricant wherein said conversion coating increases the anti-friction properties of said dry lubricant.

3. A process for preparing an aqueous friction-reducing additive, comprising the steps of:
1) forming a solution of water with phosphoric acid or sulfuric acid;
2) thereafter adding ammonium hydroxide slowly to the solution of step 1) over a period of at least 10 minutes;
3) thereafter adding an alkali metal hydroxide in water to the solution produced by step 2);
4) thereafter adding ammonium hydroxide to the solution produced by step 3) to bring the pH to 10-11;
5) thereafter adding potassium hydroxide to the solution produced by step 4) to bring the pH to 14; and
6) adding one or more non-alkaline metal salts to the solution produced by step 5),
wherein the solution produced by step 6) forms a conversion coating on a surface when applied to the surface without the use of applied external electromotive force, and wherein said conversion coating contains potassium, phosphorus, nitrogen, and one or more non-alkali metals.

4. A composition for lubrication of a surface, comprising a motor oil, a gear oil, a spin, drawing, or extrusion finish oil, or a hydraulic fluid combined in 60 to 80 parts by volume to 1 part of an aqueous solution by volume produced by a process comprising the steps of:
1) forming a solution of water with phosphoric acid or sulfuric acid;
2) thereafter adding ammonium hydroxide slowly to the solution of step 1) over a period of at least 10 minutes;
3) thereafter adding an alkali metal hydroxide in water to the solution produced by step 2);
4) thereafter adding ammonium hydroxide to the solution produced by step 3) to bring the pH to 10-11;
5) thereafter adding potassium hydroxide to the solution produced by step 4) to bring the pH to 14; and
6) adding one or more non-alkaline metal salts to the solution produced by step 5),
wherein the solution produced by step 6) forms a conversion coating on a surface when applied to the surface without the use of applied external electromotive force, and wherein said conversion coating contains potassium, phosphorus, nitrogen, and one or more non-alkali metals.

5. A conversion coating comprising one or more non-alkaline metals, wherein said conversion coating is produced by a process comprising the steps of:
1) forming a solution of water with phosphoric acid or sulfuric acid;
2) adding ammonium hydroxide to the solution of step 1);
3) adding an alkali metal hydroxide in water to the solution produced by step 2);
4) adding ammonium hydroxide to the solution produced by step 3) to bring the pH to 10-11;
5) adding potassium hydroxide to the solution produced by step 4) to bring the pH to 14; and
6) adding one or more non-alkaline metal salts to the solution produced by step 5),
wherein the solution produced step 6) forms a conversion coating on a surface when applied to the surface without the use of applied external electromotive force, and wherein said conversion coating contains one or more non-alkali metals.

6. The conversion coating of claim 5, further comprising a coating of dry lubricant wherein said conversion coating increases the anti-friction properties and wear performance of said dry lubricant.

7. A process for preparing an aqueous friction-reducing additive, comprising the steps of:
1) forming a solution of water with phosphoric acid or sulfuric acid;
2) adding ammonium hydroxide to the solution of step 1);
3) adding an alkali metal hydroxide in water to the solution produced by step 2);
4) adding ammonium hydroxide to the solution produced by step 3) to bring the pH to 10-11;
5) adding potassium hydroxide to the solution produced by step 4) to bring the pH to 14; and
6) adding one or more non-alkaline metal salts to the solution produced by step 5),
wherein the solution produced by step 6) forms a conversion coating on a surface when applied to the surface without the use of applied external electromotive force, and wherein said conversion coating contains one or more non-alkali metals.

8. A composition for lubrication of a surface, comprising a motor oil, a gear oil, a spin, drawing, or extrusion finish oil, or a hydraulic fluid combined in 60 to 80 parts by_volume to 1 part of an aqueous solution by volume produced by a process comprising the steps of:
1) forming a solution of water with phosphoric acid or sulfuric acid;
2) adding ammonium hydroxide to the solution of step a);
3) adding an alkali metal hydroxide in water to the solution produced by step b);
4) adding ammonium hydroxide to the solution produced by step c) to bring the pH to 10-11;
5) adding potassium hydroxide to the solution produced by step d) to bring the pH to 14; and
6) adding one or more non-alkaline metal salts to the solution produced by step e),
wherein the solution produced by step 6) forms a conversion coating on a surface when applied to the surface without the use of applied external electromotive force, and wherein said conversion coating contains one or more non-alkali metals.

9. The composition of claim 8, wherein, when said solution produced by step 6) is combined with said motor oil, gear oil, spin, drawing, or extrusion finish oil, or hydraulic fluid, said solution produced by step 6) improves the wear performance and lubrication properties of said motor oil, gear oil, spin, drawing, or extrusion finish oil, or a hydraulic fluid.

10. A method for reducing friction on a surface, comprising the steps of:

1) providing an aqueous anti-friction solution comprising the steps of:
   a) forming a solution of water with phosphoric acid or sulfuric acid;
   b) thereafter adding ammonium hydroxide slowly to the solution of step a) over a period of at least 10 minutes;
   c) thereafter adding an alkali metal hydroxide in water to the solution produced by step b);
   d) thereafter adding ammonium hydroxide to the solution produced by step c) to bring the pH to 10-11;
   e) thereafter adding potassium hydroxide to the solution produced by step d) to bring the pH to 14; and
   f) adding one or more non-alkaline metal salts to the solution produced by step e) and
2) applying said aqueous anti-friction solution to the surface without the use of applied external electromotive force.

11. The method of claim 10 wherein said aqueous anti-friction solution is first combined with a motor oil, a gear oil, a spin, drawing, or extrusion finish oil, or a hydraulic fluid and then applied to the surface.

12. The method of claim 10 wherein said aqueous anti-friction solution forms an anti-friction conversion coating on the surface.

13. The method of claim 12 further comprising a coating of dry lubricant wherein said conversion coating increases the anti-friction properties and wear performance of said dry lubricant.

14. The method of claim 12 wherein said anti-friction conversion coating contains potassium, phosphorus, nitrogen and one or more non-alkali metals, and wherein said anti-friction conversion coating reduces friction of the surface.

15. A method for reducing friction on a surface, comprising the steps of:

1) providing an aqueous anti-friction solution comprising the steps of:
   a) forming a solution of water with phosphoric acid or sulfuric acid;
   b) adding ammonium hydroxide to the solution of step a);
   c) adding an alkali metal hydroxide in water to the solution produced by step b);
   d) adding ammonium hydroxide to the solution produced by step c) to bring the pH to 10-11;
   e) adding potassium hydroxide to the solution produced by step d) to bring the pH to 14; and
   f) adding one or more non-alkaline metal salts to the solution produced by step e); and
2) applying said aqueous anti-friction to the surface without the use of applied external electromotive force.

16. The method of claim 15 wherein said aqueous anti-friction solution is first combined with a motor oil, a gear oil, a spin, drawing, or extrusion finish oil, or a hydraulic fluid and then applied to the surface.

17. The method of claim 15 wherein said aqueous anti-friction solution forms an anti-friction conversion coating on the surface.

18. The method of claim 17 further comprising a coating of dry lubricant wherein said conversion coating increases the anti-friction properties and wear performance of said dry lubricant.

19. The method of claim 18 wherein said anti-friction conversion coating contains one or more non-alkali metals.

20. A conversion coating comprising potassium, phosphorus, nitrogen, and one or more non-alkaline metals and/or one or more metalloids, wherein said conversion coating is produced by a process comprising the steps of:

1) forming a solution of water with phosphoric acid or sulfuric acid;
2) thereafter adding ammonium hydroxide slowly to the solution of step 1) over a period of at least 10 minutes;
3) thereafter adding an alkali metal hydroxide in water to the solution produced by step 2);
4) thereafter adding ammonium hydroxide to the solution produced by step 3) to bring the pH to 10-11;
5) thereafter adding potassium hydroxide to the solution produced by step 4) to bring the pH to 14; and
6) adding one or more non-alkaline metal salts and/or one or more metalloids to the solution produced by step 5), wherein the solution provided by step 6) forms a conversion coating on a surface when applied to the surface without the use of applied external electromotive force, and wherein said conversion coating contains potassium, phosphorus, nitrogen, and one or more non-alkali metals and/or one or more metalloids.

21. The conversion coating of claim 20 wherein said metalloid is boric acid.

22. The conversion coating of claim 20, further comprising a coating of dry lubricant wherein said conversion coating increases the anti-friction properties of said dry lubricant.

23. A process for preparing an aqueous friction-reducing additive, comprising the steps of:

1) forming a solution of water with phosphoric acid or sulfuric acid;
2) thereafter adding ammonium hydroxide slowly to the solution of step 1) over a period of at least 10 minutes;
3) thereafter adding an alkali metal hydroxide in water to the solution produced by step 2);
4) thereafter adding ammonium hydroxide to the solution produced by step to bring the pH to 10-11;
5) thereafter adding potassium hydroxide to the solution produced by step 4) to bring the pH to 14; and
6) adding one or more non-alkaline metal salts and/or one or more metalloids to the solution produced by step 5), wherein the solution produced by step 6) forms a conversion coating on a surface when applied to the surface without the use of applied external electromotive force, and wherein said conversion coating contains potassium, phosphorus, nitrogen, and one or more non-alkali metals and/or one or more metalloids.

24. The conversion coating of claim 23 wherein said metalloid is boric acid.

25. A composition for lubrication of a surface, comprising a motor oil, a gear oil, a spin, drawing, or extrusion finish oil, or a hydraulic fluid combined in 60 to 80 parts by volume to 1 part of an aqueous solution by volume produced by a process comprising the steps of:

1) forming a solution of water with phosphoric acid or sulfuric acid;
2) thereafter adding ammonium hydroxide slowly to the solution of step 1) over a period of at least 10 minutes;
3) thereafter adding an alkali metal hydroxide in water to the solution produced by step 2);
4) thereafter adding ammonium hydroxide to the solution produced by step 3) to bring the pH to 10-11;
5) thereafter adding potassium hydroxide to the solution produced by step 4) to bring the pH to 14; and
6) adding one or more non-alkaline metal salts and/or one or more metalloids to the solution produced by step 5), wherein the solution produced by step 6) forms a conversion coating on a surface when applied to the surface without the use of applied external electromotive force, and wherein said conversion coating contains potassium, phosphorus, nitrogen, and one or more non-alkali metals and/or one or more metalloids.

26. The composition of claim 25 wherein said metalloid is boric acid.

* * * * *